US005872805A

United States Patent [19]

Mortimer et al.

[11] Patent Number: 5,872,805

[45] Date of Patent: Feb. 16, 1999

[54] POT FOR COATING CONTINUOUS METALLIC STRIP

[75] Inventors: John H. Mortimer, Mt. Laurel, N.J.; Hans G. Heine, San Mateo, Fla.

[73] Assignee: Inductotherm Corp., Rancocas, N.J.

[21] Appl. No.: 696,538

[22] Filed: Aug. 14, 1996

[51] Int. Cl.[6] ..... H05B 6/22

[52] U.S. Cl. ..... 373/151; 373/159; 219/609; 427/321

[58] Field of Search ..... 373/151, 142, 373/146, 159; 219/600, 609, 634, 635; 427/321, 349, 433, 45; 118/63, 67, 69

[56] References Cited

U.S. PATENT DOCUMENTS

| | | | |
|---|---|---|---|
| 3,519,719 | 7/1970 | Fadler | 13/34 |
| 3,602,625 | 8/1971 | Duca et al. | 13/27 |
| 3,779,056 | 12/1973 | Padjen et al. | 72/47 |
| 3,813,470 | 5/1974 | Duca | 13/29 |
| 3,887,721 | 6/1975 | Schwieterman | 427/45 |
| 3,977,842 | 8/1976 | Mayhew | 29/196.5 |
| 4,755,137 | 7/1988 | Barbe et al. | 432/2 |
| 4,761,530 | 8/1988 | Scherer et al. | 219/10.71 |
| 5,354,970 | 10/1994 | Knupfer | 219/609 |

FOREIGN PATENT DOCUMENTS

| | | |
|---|---|---|
| 0 230 180 | 7/1987 | European Pat. Off. . |
| 90 16 284 | 5/1991 | Germany . |
| 59-129761 | 7/1984 | Japan . |
| 59-226166 | 12/1984 | Japan . |
| 662524 | 12/1951 | United Kingdom . |
| 753470 | 7/1956 | United Kingdom . |

OTHER PUBLICATIONS

Patent Abstracts of Japan, vol. 097, No. 004 30 Apr. 1997 & JP 08 337855 (Kawasaki Steel Corp.) 24 Dec. 1996.

Patent Abstracts of Japan, vol. 003, No. 118 (C–060) 4 Oct. 1979 & JP 54 100934 (Asahi Glass Co. Ltd; Others:01) 9 Aug. 12979.

Patent Abstracts of Japan, vol. 095, No. 006, 31 Jul. 1995 & JP 07 076760 A (Kawasaki Steel Corp), 20 Mar. 1995.

*Primary Examiner*—Tu Ba Hoang
*Attorney, Agent, or Firm*—Seidel, Gonda, Lavorgna & Monaco, PC

[57] ABSTRACT

A hot dip coating pot for containing a coating material in a liquid state. The coating pot comprises a substantially horizontal bottom and substantially vertical side walls. The bottom and the side walls define a first interior volume for containing the coating material. The bottom wall and a lower portion of each of the side walls defines a bottom portion which is separable from an upper portion of the side walls. The bottom portion has a predetermined interior volume less than the first interior volume.

9 Claims, 4 Drawing Sheets

POT FOR COATING CONTINUOUS METALLIC STRIP

FIELD OF THE INVENTION

The present invention relates to hot dip coating of continuous metallic strip, and is particularly, but by no means exclusively, applicable to the coating of ferrous metals with zinc, aluminum, and other coatings.

BACKGROUND OF THE INVENTION

In coating of ferrous metals, such as in galvanizing, parts to be coated are immersed into a bath coating material after having been chemically pretreated and cleaned. The amount of time the parts stay immersed depends upon the material of the parts, their shapes, the bath temperature, the coating composition, and the desired coating thickness.

Coating is frequently used to coat continuous strips of ferrous base metal to produce iron or steel strip stock having a thin coating of zinc, aluminum, or the like. In continuous-strip coating, the strip to be coated is first cleaned and pretreated, passed through a bath of molten coating material, and then withdrawn from the bath in a generally upward direction. The coating material adhering to the withdrawn strip is finished by coating rolls, air knives, or the like, and is subsequently solidified.

The molten coating material, usually a molten metal such as zinc, for example, is contained in an externally-heated iron or steel pot. Metal coating pots have several disadvantages, however. They have a relatively short life. This is due to several factors, including rapid build-up of dross at the bottom of the pot.

In normal operation, the coating pot is kept full with molten metal supplied via a launder from a premelter. Where a bottom dross generating alloy, such as a zinc alloy, is used, it becomes necessary to periodically empty the pot completely, and allow it to cool, to remove the dross which has collected at the bottom of the pot. To avoid this, it has been proposed to remove dross by using a circulating pump to continuously pump molten metal through a filter, to remove the dross, and return it to the coating pot. Zinc filtration is not yet a proven technology, however, and there is a need to provide an effective yet simple method of dross removal. The present invention fills that need.

SUMMARY OF THE INVENTION

The present invention is directed to a hot dip coating pot for containing a coating material in a liquid state. The coating pot comprises a substantially horizontal bottom and substantially vertical side walls. The bottom and the side walls define a first interior volume for containing the coating material. The bottom wall and a lower portion of each of the side walls defines a bottom portion which is separable from an upper portion of the side walls. The bottom portion has a predetermined interior volume less than the first interior volume.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
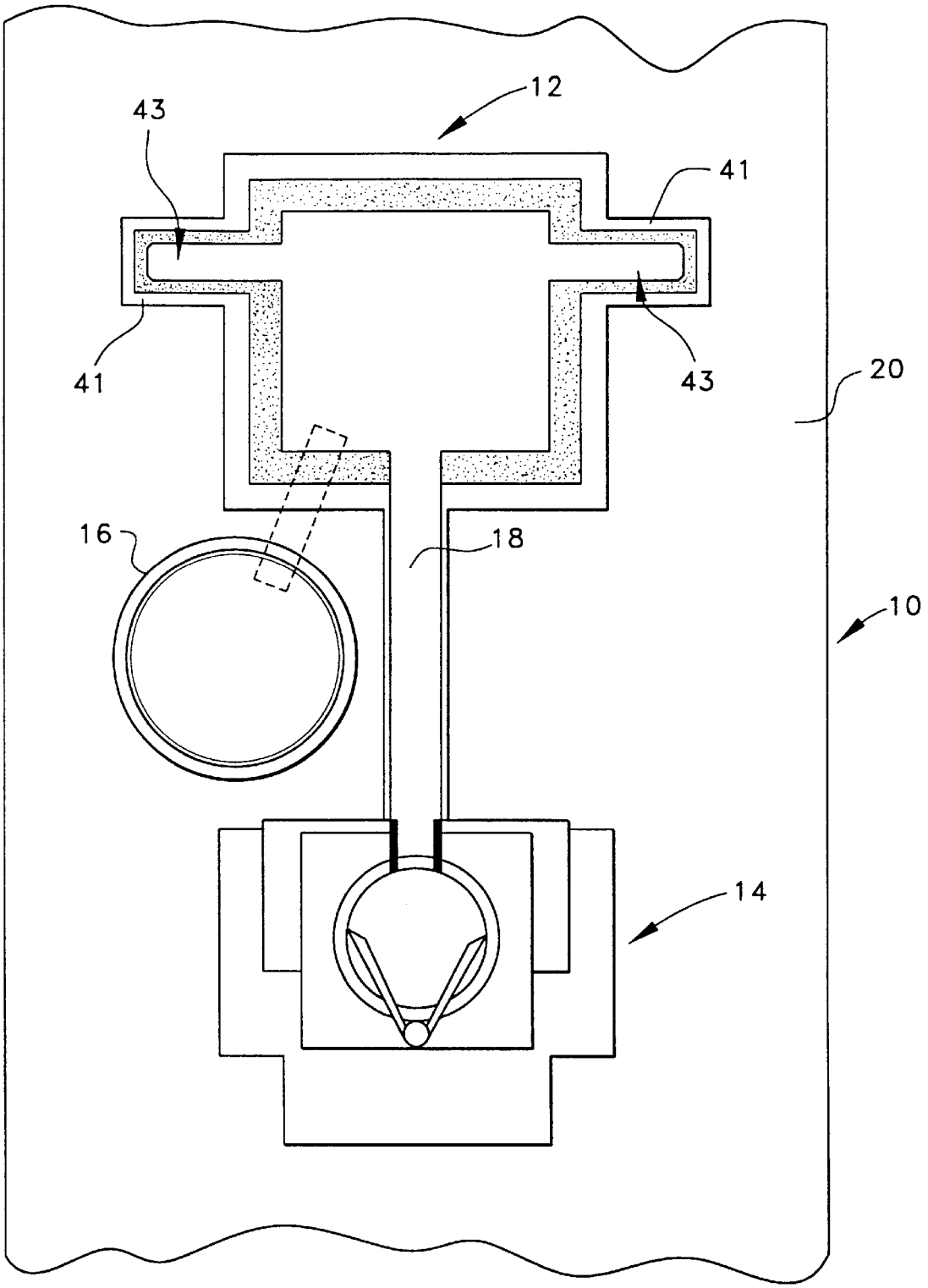
FIG. 1 is a top plan view of a coating installation employing a coating pot according to the invention.

Referring now to the drawings, wherein like numerals indicate like elements, there is shown in FIG. 1 a coating installation 10 incorporating a coating pot 12 according to the invention. Installation 10 comprises, in addition to coating pot 12, a coreless induction melter 14 and a holding pot 16 located between the coreless melter 14 and the coating pot 12. Molten metal is supplied to coating pot 12 via a launder 18. The holding pot 16 holds molten coating metal, which is pumped from coating pot 12 via pump to holding pot 16 when it is desired to empty coating pot 12, and which is pumped from holding pot 16 to coating pot 12 when it is desired to refill coating pot 12. Molten metal pumps for transferring molten metal between coating pot 12 and holding pot 16 are commercially available, and are known per se to those skilled in the art.

The coating installation 10 is supported on a deck or floor 20, except as will be described below.

Figure 2:
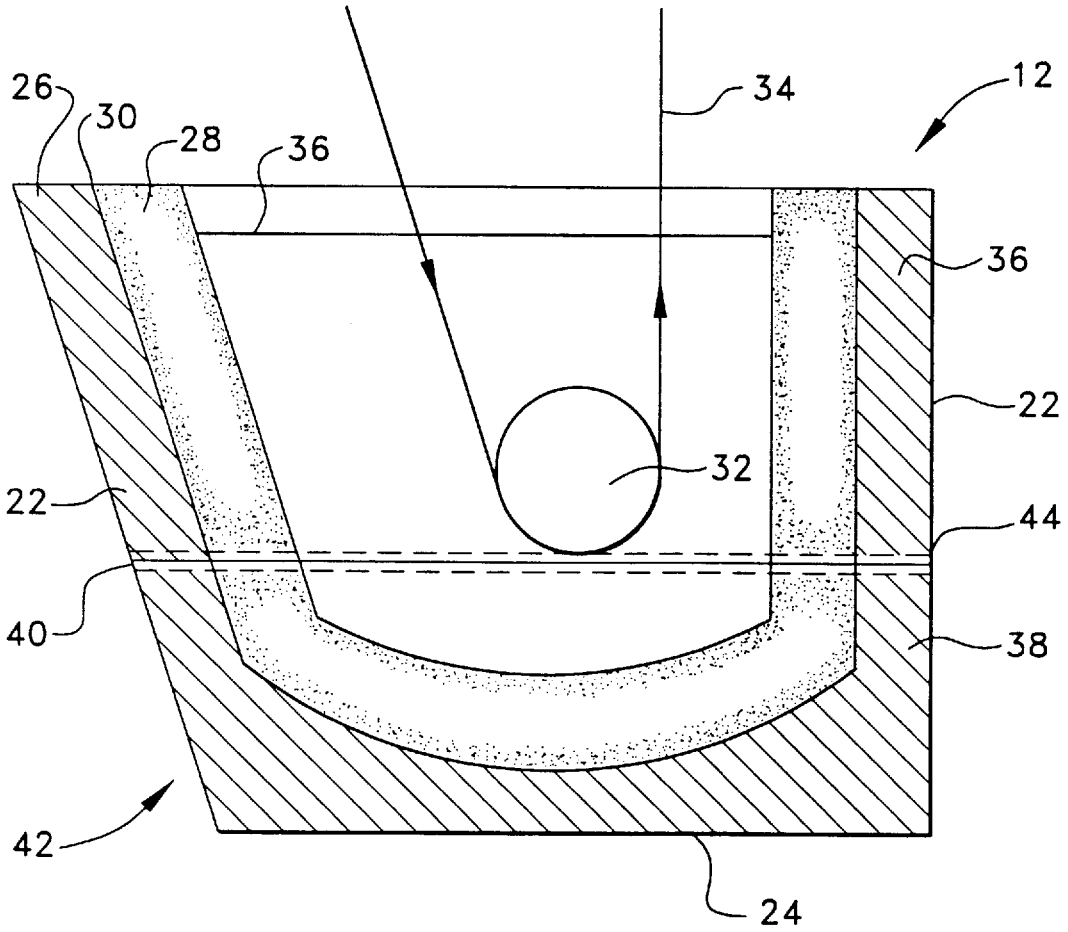
FIG. 2 is a vertical sectional view through a coating pot according to the invention.

A vertical section through coating pot 12 is illustrated in FIG. 2. Coating pot comprises side walls 22 and a substantially horizontal bottom 24. Together, the side walls 22 and bottom 24 define an interior volume for containing molten coating material. Side walls 22 and bottom 24 are made of refractory materials, such as, for example, a "cold face" layer 26 and a "hot face" layer 28 of refractory material 30. More details of this aspect of the construction of coating pot may be had by reference to U.S. Pat. No. 5,354,970, assigned to the same assignee as the present invention, and which is incorporated herein by reference.

A difference between coating pot 12 and prior coating pots is that each side wall 22 is divided into an upper portion 36 and a lower portion 38 along a parting line 40. Lower portions 38 of side walls 22 are joined to bottom 24, and together define a bottom portion 42 which is separable from the upper portions 36 along the parting line 40. The lower portions 38 and bottom 24 define a predetermined interior volume which is less that the interior volume of coating pot 12. If desired, a suitable seal 44 may be provided between upper portions 36 and lower portions 38 of side walls 22, so that molten metal does not leak out of pot 12 along parting line 40.

As seen in FIG. 1, coreless induction furnaces 41 are mounted on opposite side walls of the coating pot 12. Each coreless induction furnace 41 defines an interior volume 43 therein in communication with the interior volume of the coating pot 12 for inductively heating the coating material.

Figure 3:
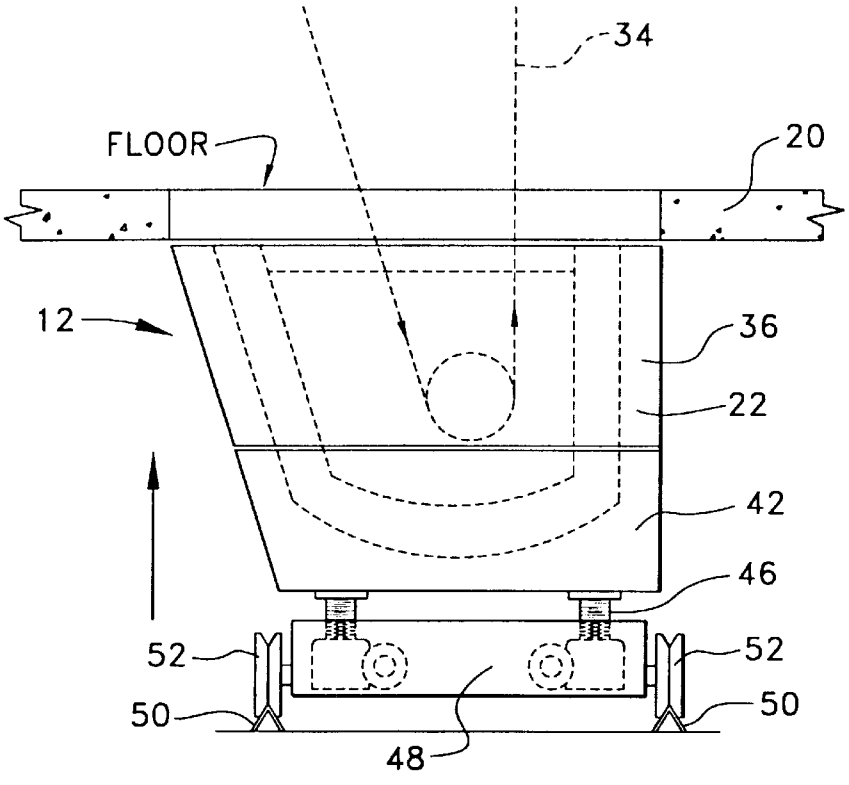

As seen in FIG. 3, coating pot 12 is located below the level of the deck 20. Bottom portion 42 is supported and held in place against upper wall portions 22 by mechanical, hydraulic, or pneumatic jack screws 46 on transfer car 48, which is movable along a pair of rails 50 by means of wheels 52. Rails 50 are located on a floor below and spaced from deck 20. Transfer car 48 and bottom portion 42 are moved into place below coating pot 12, and then jack screws 46 are actuated to elevate bottom portion 42 into contact with the upper portions 36 of side walls 22.

Figure 6:
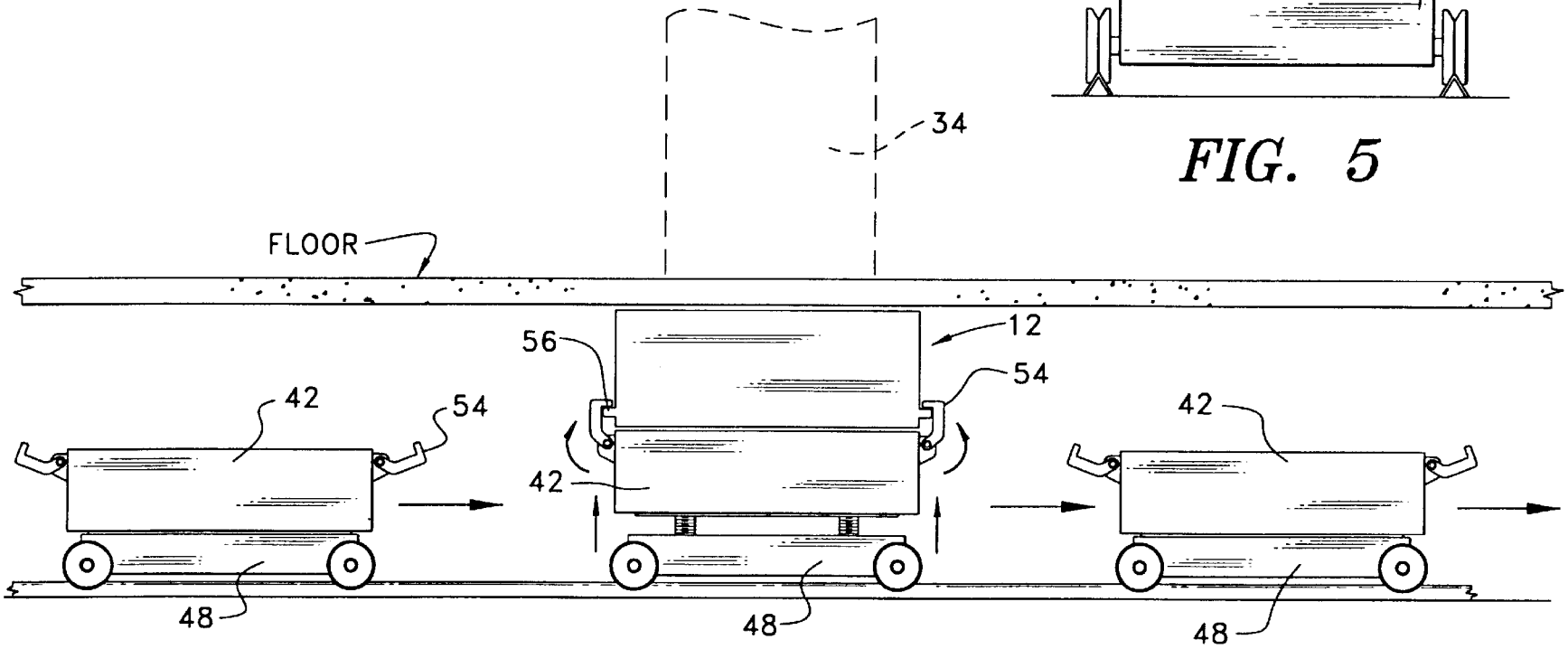
FIG. 6 illustrates how interchangeable bottoms may be removed and replaced from beneath the coating installation to increase cycle time.

As seen in FIG. 6, bottom portions 42 may be provided with a latch mechanism 54 which cooperates with projections 56 on the outer surface of upper portions 36 of side walls 22. The latch mechanism 54 is preferably remotely operable, such as by a hydraulic cylinder or by an electromechanical device (e.g., a solenoid). Latch mechanism 54 and projections 56 cooperate to secure bottom portions 42 to upper portions 36. With the bottom portion 42 in place, molten coating metal can be added to coating pot 12 and the coating process of strip 34 can begin.

Although the latch mechanisms 54 are shown as being located on bottom portion 42, they may also be located on the lower portions of side walls 22.

Figure 4:
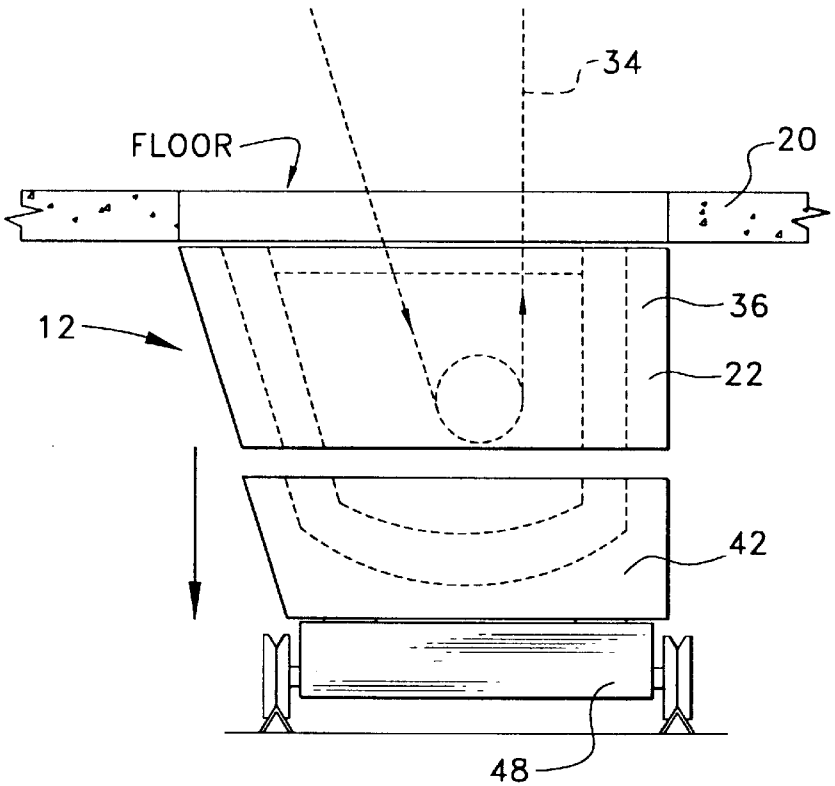
FIGS. 3 and 4 illustrate installation and removable of the bottom portion of the coating pot illustrated in FIG. 2.
Figure 5:
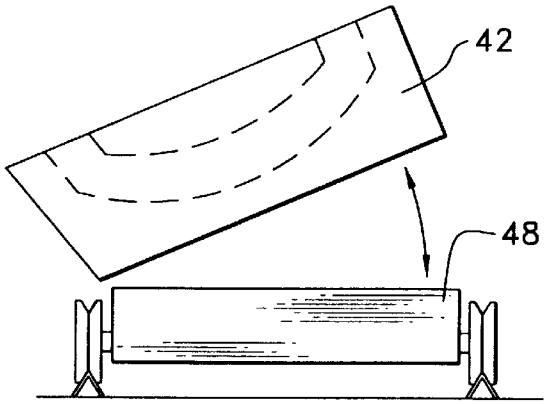
FIG. 5 illustrates how the bottom portion may be emptied of dross after it has been removed from the pot.

As the pot is used, dross is formed. In many cases, such as where the coating material is zinc, the dross is denser than the molten metal, and tends to sink and collect in the bottom portion 42. Periodically, the coating process must be stopped and the dross removed. This is easily done by lowering bottom portion 42, after coating pot 12 has been emptied of molten coating metal. When coating pot 12 has been safely emptied of molten metal, the locking clamps are released, the jack screws 46 are actuated, and bottom portion 42 is lowered downward onto the bed of transfer car 48, as seen in FIG. 4. Sufficient distance is provided so that, when lowered, bottom portion 42 clears the upper portions 36 of side walls 22. After bottom portion 42 has been fully lowered onto the bed of transfer car 48, transfer car is moved along rails 50 to a position away from installation 10 where bottom portion can be emptied. If desired, bottom portion 42 may be tilted for emptying, as illustrated in FIG. 5.

As also seen in FIG. 6, several bottom portions 42 may be provided, each on its own transfer car 48, so that while one bottom portion is being conveyed away from coating pot 12 for emptying, another is put into place below coating pot 12, while a third is available for use when needed. In this manner, downtime of coating installation can be greatly reduced, since coating pot 12 can be used with a clean bottom portion while the previously used, dross-containing bottom portion is being emptied.

For dross removal, coating pot 12 is emptied, such as by pumping molten metal out of it, to a level below parting line 40. While the jack screws 46 support bottom portion 42, latch mechanisms 54 are released and bottom portion 42 containing the dross is lowered by jack screws 46 to the bed of transfer car 48. Bottom portion 42 containing the dross is conveyed by transfer car 48 to a tipping station, where it is tipped, as illustrated in FIG. 5, and its contents dumped. In the meantime, a new bottom portion 42 is moved into place below coating pot 12, and raised into place by jack screws 46. Latch mechanisms 54 are the actuated to secure the new bottom portion 42 onto coating pot 12. After the new bottom portion 42 is secured to coating pot 12, coating pot 12 is filled, such as by pumping molten metal from one of the holding pots 16.

An advantage of the invention is the speed with which the coating pot may be emptied of dross and refilled for subsequent use. Total elapsed time, including emptying the coating pot, exchanging bottom portions, and refilling the coating pot, is estimated to be only about an hour.

The present invention may be embodied in other specific forms without departing from the spirit or essential attributes thereof and, accordingly, reference should be made to the appended claims, rather than to the foregoing specification, as indicating the scope of the invention.

We claim:

1. A hot dip coating pot for containing a coating material in a liquid state, comprising a substantially horizontal bottom and substantially vertical side walls, the bottom and the side walls defining a first interior volume for containing the coating material, the bottom wall and a lower portion of each of the side walls defining a bottom portion which is separable from an upper portion of the side walls, the bottom portion having a predetermined interior volume less than said first interior volume; at least one coreless induction furnace means mounted on one of the side walls, the coreless induction furnace means defining an interior volume therein in communication with the first interior volume of the pot for inductively heating the coating material.

2. A hot dip coating pot according to claim 1, further comprising a latch mechanism for releasably securing the bottom portion to said side walls.

3. A hot dip coating pot according to claim 1, wherein the pot has an interior lining of refractory material.

4. A hot dip coating pot according to claim 1, further comprising a seal between the bottom portion and the side walls.

5. A hot dip coating pot for containing a coating material in a liquid state, comprising a substantially horizontal bottom and substantially vertical side walls, the bottom and the side walls defining a first interior volume for containing the coating material, the pot having an interior lining of refractory material and at least one coreless induction furnace means mounted on one of the side walls, the coreless induction furnace means defining an interior volume therein in communication with the first interior volume of the pot for inductively heating the coating material, the bottom wall and a lower portion of each of the side walls defining a bottom portion which is separable from an upper portion of the side walls, the bottom portion having a predetermined interior volume less than the first interior volume, a seal between the bottom portion and the side walls, and a latch mechanism for releasably securing the bottom portion to the side walls.

6. A hot dip coating installation, comprising a melting furnace for melting coating material, at least one containing pot in communication with the melting furnace for containing coating material melted in the melting furnace, a holding pot in communication with the containing pot, a pump connected between the coating pot and the holding pot for transferring molten coating material between the holding pot and the coating pot, the coating pot having a removable bottom portion, and a movable vehicle for conveying the bottom portion to a position below the coating pot and for defining an interior volume therein in communication with the first interior volume of the pot for inductively heating the coating material.

7. A hot dip coating installation as in claim 6, further comprising a seal between the bottom portion and the coating pot.

8. A hot dip coating installation as in claim 6, further comprising a latch mechanism for releasably securing the bottom portion to the coating pot.

9. A hot dip coating installation as in claim 6, further comprising at least one coreless induction furnace means mounted on at least one side wall of the coating pot, the coreless induction furnace means defining an interior volume therein in communication with the interior of the coating pot for inductively heating the coating material.

* * * * *